US006497549B2

(12) United States Patent
Brown

(10) Patent No.: US 6,497,549 B2
(45) Date of Patent: Dec. 24, 2002

(54) COUNTER-EJECTOR

(75) Inventor: Kevin P. Brown, Nine Mile Falls, WA (US)

(73) Assignee: J & L Development, Inc., Keithville, LA (US)

( * ) Notice: Subject to any disclaimer, the term of this patent is extended or adjusted under 35 U.S.C. 154(b) by 0 days.

(21) Appl. No.: 09/750,811

(22) Filed: Dec. 27, 2000

(65) Prior Publication Data

US 2002/0081188 A1 Jun. 27, 2002

(51) Int. Cl.[7] ..... B65G 57/00

(52) U.S. Cl. ..... 414/790.3; 414/789.9; 414/790.8

(58) Field of Search ..... 414/790.3, 790, 414/788.9, 790.8

(56) References Cited

U.S. PATENT DOCUMENTS 3,381,829 A * 5/1968 Turner ..... 214/6
3,580,402 A 5/1971 Tolf et al.
3,698,708 A * 10/1972 Brawn ..... 271/74
3,892,168 A * 7/1975 Grobman ..... 93/93
3,905,487 A 9/1975 Hoke et al.
3,938,674 A 2/1976 Kroeze et al.
4,085,566 A * 4/1978 Crowe et al. ..... 53/124 D
4,134,330 A * 1/1979 Weickenmeier ..... 93/93 M
4,359,218 A 11/1982 Karis
4,425,068 A 1/1984 Wilson et al.
4,512,701 A * 4/1985 Foust et al. ..... 414/101
4,577,746 A 3/1986 Tokuno et al.
4,667,953 A 5/1987 Hirakawa et al.
5,039,083 A 8/1991 Senn
5,980,196 A * 11/1999 Roth ..... 414/790.8

* cited by examiner

*Primary Examiner*—Kathy Matecki
*Assistant Examiner*—Michael Lowe
(74) *Attorney, Agent, or Firm*—Wells St. John P.S.

(57) ABSTRACT

A counter-ejector is described for stacking relatively flat sheet articles. The counter-ejector includes a main frame that is selectively movable about a pivot axis. An infeed conveyor is provided on the main frame defining a forward path of travel for sheet articles. The infeed conveyor includes a discharge end positioned adjacent a stack forming magazine where individual sheet articles from the infeed conveyor accumulate in a stack. An ejector adjacent the stack forming magazine is movable across the stack forming magazine from a stack engaging position adjacent the stack forming magazine to a shifted position at a stack compression station. A stack compressor at the stack compression station is positioned to receive a stack of sheet articles from the ejector. A compression linkage joins the stack compressor and main frame, with links arranged to adjustably open and close the stack compressor responsive to movement of the main frame about the pivot axis.

30 Claims, 11 Drawing Sheets

COUNTER-EJECTOR

TECHNICAL FIELD

The present invention relates to receiving and forming a selected number of individual sheet materials into a stack and discharging the formed stack.

BACKGROUND OF THE INVENTION

Sheet materials such as corrugated paper used for box construction, are typically die-cut, printed, perforated or otherwise treated by a finishing machine. The flat blanks may be folded with joints secured by glue, while still in substantially flat configurations for later assembly. It is desirable to accumulate the relatively flat folded blanks in stacks that may be bound with straps or otherwise secured for shipment or storage until such time that a need arises for the blanks to be formed into boxes.

Forming rails and glue application heads are typically used downstream of the finishing machine to form the sheet material into desired configurations as they move along. A typical configuration is a partially folded box, the folding process for which is exemplified in FIG. 1 of the drawings.

In existing technology, the boxes are counted and accumulated in bundles by a counter-ejector machine. This is an area where difficulty is experienced, since the boxes being fed along a plane, in end-to-end relation often have a tendency to re-open at the glue lines (see FIG. 1) as they leave the folding rails. If a glue line re-opens, the loose flaps can cause frustrating and costly down-time while the single box blank is pulled from the counter-ejector.

Finishing machines, folding rails and glue applicators can be operated at fairly high speeds (in the area of 1000 feet per minute output). Stacking machinery, on the other hand is typically unable to operate sufficiently fast to stack the blanks at a similar rate. It therefore becomes desirable to provide a counter-ejector that will accumulate and stack sheets at an acceptably fast rate to avoid or minimize slowing or periodic stopping of the upstream machinery. An attempt has been made to increase the effective sheet handling speed by shingling sheets in a counter-ejector just prior to formation of the sheet stacks. The intent was to overlap and feed the sheets in a stream to a stacking station. However, control of the individual sheets was somewhat compromised and periodic jams could occur.

A problem also recognized with existing forms of counter-ejectors is that numerous controls, timing, and individual adjustments were required each time a stack of a different height or sheets of different dimension were to be stacked. Such complexities can lead to increased chances for error and increased maintenance and repair. A need has therefore been realized for simplification of counter-ejector construction.

Another problem area with counter-ejectors occurs in the stacking area where the sheets are fed into a stacking magazine. Sheets must transition from a substantially horizontal path of travel at a selected feed rate, stop abruptly, and change direction from the substantially horizontal feed path to a substantially vertical movement order to accumulate in a stack. Sheets are typically fed substantially horizontally with narrow edges facing the direction of travel and the large surface areas oriented substantially parallel to the horizontal path. Since the large surface areas of the sheets must become substantially perpendicular to the new path of movement during stacking, air resistance becomes a concern. The sheets, in other words, want to "parachute" in the stacking magazine.

An attempted solution to the air resistance problem has been to mechanically alter the path of movement at the discharge into the stacking magazine. While this allows some mechanical control to remain, the air resistance against the large sheet surface area remains during the transition from horizontal to vertical movement. Thus, a need also remains to provide control of the sheets during the horizontal to vertical transition, and to minimize the effects of air resistance as the sheets move vertically.

The present invention is intended to fill the above needs, as may be understood from the following description.

BRIEF DESCRIPTION OF THE DRAWINGS

Preferred embodiments of the invention are described below with reference to the following accompanying drawings.

FIG. 4 is an enlarged, fragmented view showing sheet feed to a sheet stacking magazine and components of a compression conveyor;

FIG. 5 is a view similar to FIG. 3 only showing the sheet feed magazine with a full stack of sheets in position ready to be discharged to a stack compressor, and accumulation of sheets on separator forks above the accumulated stack;

FIG. 10 is a fragmented enlarged plan view of an infeed hold down conveyor belt with blow down air holes formed therein;

DETAILED DESCRIPTION OF THE PREFERRED EMBODIMENTS

Figure 1:
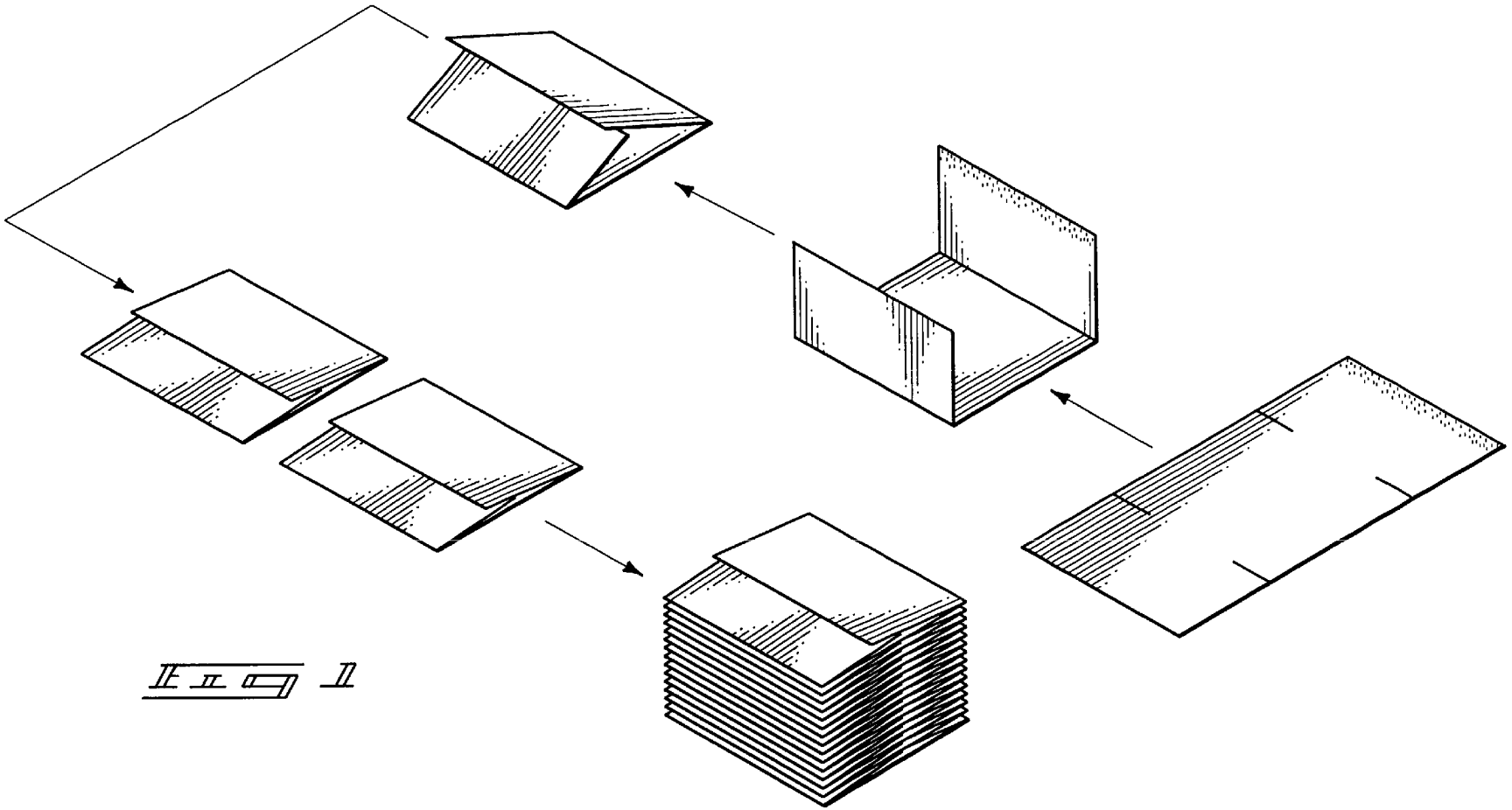
FIG. 1 is a diagrammatic view illustrating exemplary steps taken to form a sheet of material into a folded blank, and an arrangement of the sheets into a stack.

This disclosure of the invention is submitted in furtherance of the constitutional purposes of the U.S. Patent Laws "to promote the progress of science and useful arts" (Article 1, Section 8).

GENERAL ASPECTS

Before describing details of elements comprising preferred forms of the present invention, several general aspects of the invention as a whole will be presented.

In a preferred aspect, the present counter-ejector 10 for stacking relatively flat sheet articles includes a main frame 12 selectively movable about a pivot axis X. An infeed conveyor 14 is provided on the main frame defining a forward path of travel for sheet articles. The infeed conveyor 14 includes a discharge end 16 positioned adjacent a stack forming magazine 18 where individual sheet articles from the infeed conveyor 14 accumulate in a stack. An ejector 20 is located adjacent the stack forming magazine 18 and is movable across the stack forming magazine 18 from a stack engaging position adjacent the stack forming magazine 18 to a shifted position at a stack compression station. A stack compressor 22 at the stack compression station is positioned to receive a stack of sheet articles from the ejector 20. A compression linkage 24 joins the stack compressor and main frame, with links 26 arranged to adjustably open and close the stack compressor 22 responsive to movement of the main frame about the pivot axis.

In another aspect, the present counter-ejector 10 for stacking relatively flat sheet articles includes a fixed base 11. A main frame 12 is provided on the base selectively movable about a pivot axis X. An infeed conveyor 14 is provided on the main frame defining a forward path of travel for sheet articles from an infeed end 15 adjacent the pivot axis X. The infeed conveyor also includes a discharge end 16 positioned adjacent a stack forming magazine 18 where individual sheet articles from the infeed conveyor accumulate in a stack. An ejector 20 adjacent the stack forming magazine 18 is movable across the stack forming magazine from a stack engaging position adjacent the stack forming magazine to a shifted position at a stack compression station. A compression frame 23 is provided on the base 11 and is pivotable thereon about a compression frame axis Y adjacent a stack discharge 25 spaced downstream from the pivot axis X with respect to the forward path of travel. A stack compressor 22 includes the compression frame 23 and is situated at the stack compression station. The stack compressor 22 is positioned to receive a stack of sheet articles from the ejector 20. A compression linkage 24 joins the stack compression frame 22 and main frame 12, with links 26 arranged to adjustably open and close the stack compressor 22 responsive to relative pivotal movement of the main frame 12 and compression frame 23 about the pivot axis X and the compression frame axis Y, respectively.

In a further aspect, the present counter-ejector 10 for stacking relatively flat sheet articles includes an infeed conveyor 14 defining a forward path of travel for sheet articles. The infeed conveyor 14 includes a sheet transport flight 32 leading from an infeed end 15 to a discharge end 16 adjacent a stack forming magazine where individual sheet articles from the infeed conveyor 14 accumulate in a stack. The infeed conveyor 14 further includes a hold down conveyor 34 with a hold down flight 36 overlying the sheet transport flight 32 of the infeed conveyor 14 and extending beyond the discharge end 16 to substantially overlap the stack forming magazine 18. An ejector 20 is positioned to engage and move a stack of articles from the stack forming magazine 18.

In a further aspect, the present counter-ejector 10 for stacking relatively flat sheet articles includes a fixed base 11. A main frame 12 on the base 11 is selectively movable about a pivot axis X. An infeed conveyor 14 on the main frame leads to a discharge end 16 positioned adjacent a stack forming station where individual sheet articles are discharged in a forward and downward direction from the infeed conveyor 14 to accumulate in a stack forming magazine 18. A back stop 46 that is mounted to the main frame along a side of the stack forming magazine is located opposite the discharge end 16 of the infeed conveyor 14, and is positioned to engage and stop forward motion of sheet articles fed from the infeed conveyor 14. A lift platform 56 is mounted to the main frame and spans a bottom side 58 of the stack forming magazine 18 and is elevationally moveable toward and away from the discharge end 16 of the infeed conveyor 14. An ejector 20 on the main frame is adjacent the stack forming magazine 18 and is movable across the stack forming magazine 18 from a stack engaging position to a shifted position at a stack compression station. A compression frame 23 on the base 11 is pivotable thereon about a compression frame axis Y adjacent a stack discharge 25 spaced downstream with respect to the forward path of travel from the pivot axis X. A stack compressor 22 on the compression frame 23 and main frame at the stack compression station, is positioned to receive a stack of sheet articles from the ejector 20. A compression linkage 24 joining the stack compression frame 22 and main frame 12, includes links 26 arranged to adjustably open and close the stack compressor 22 responsive to relative pivotal movement of the main frame 12 about the pivot axis X.

In a further aspect, a process for stacking relatively flat sheet articles includes the step of feeding sheet articles on an infeed conveyor 14 mounted to a main frame 12 along a forward path of travel, and discharging the sheet articles from the infeed conveyor 14 into a stack forming magazine 18. The discharged sheet articles are accumulated within the stack forming magazine to form a stack of a selected stack height. Another step includes ejecting the stack from the stack forming magazine to a shifted position at a stack compression station, and compressing the stack with a stack compressor 22 at the stack compression station. A further step includes selectively adjusting for the stack height by pivoting the main frame 12 about a pivot axis and in response to such pivoting, adjusting the stack compressor to open and close according to the selected stack height in the stack forming magazine 18.

DETAILED DESCRIPTION

Figure 2:
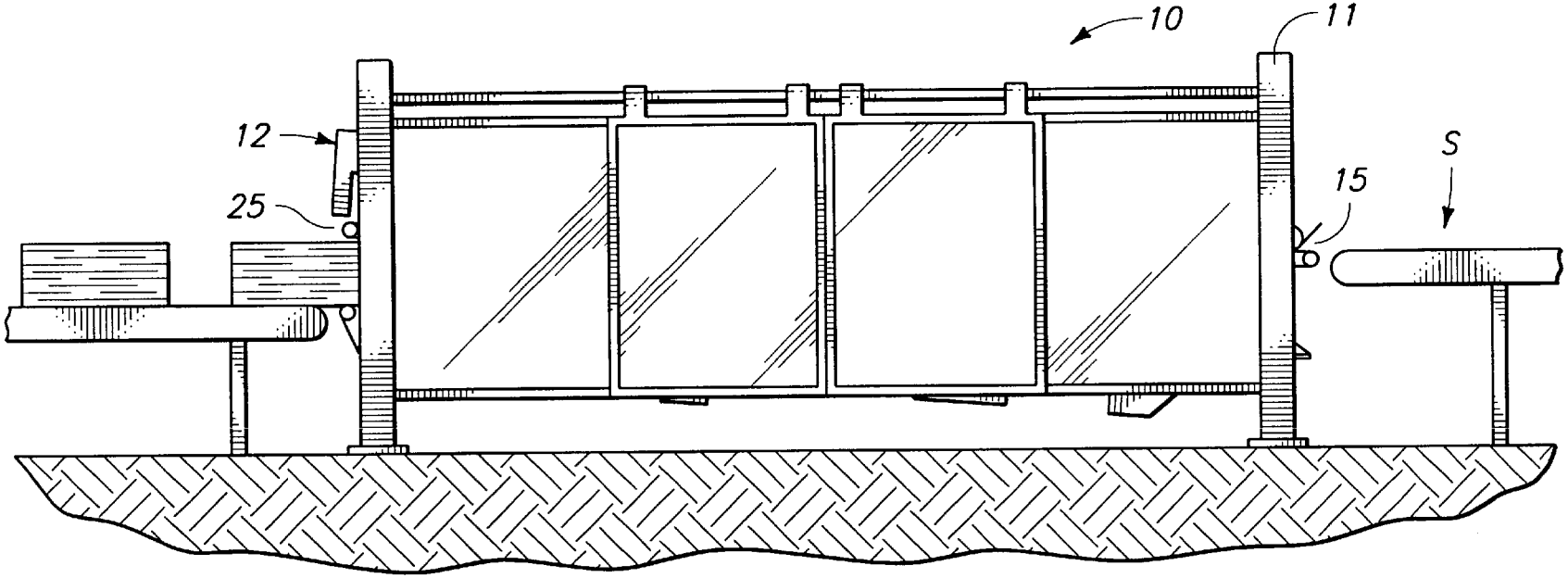
FIG. 2 is a side elevation view of a counter-ejector enclosed in a protective housing and indication infeed and discharge points for sheet materials.
Figure 3:
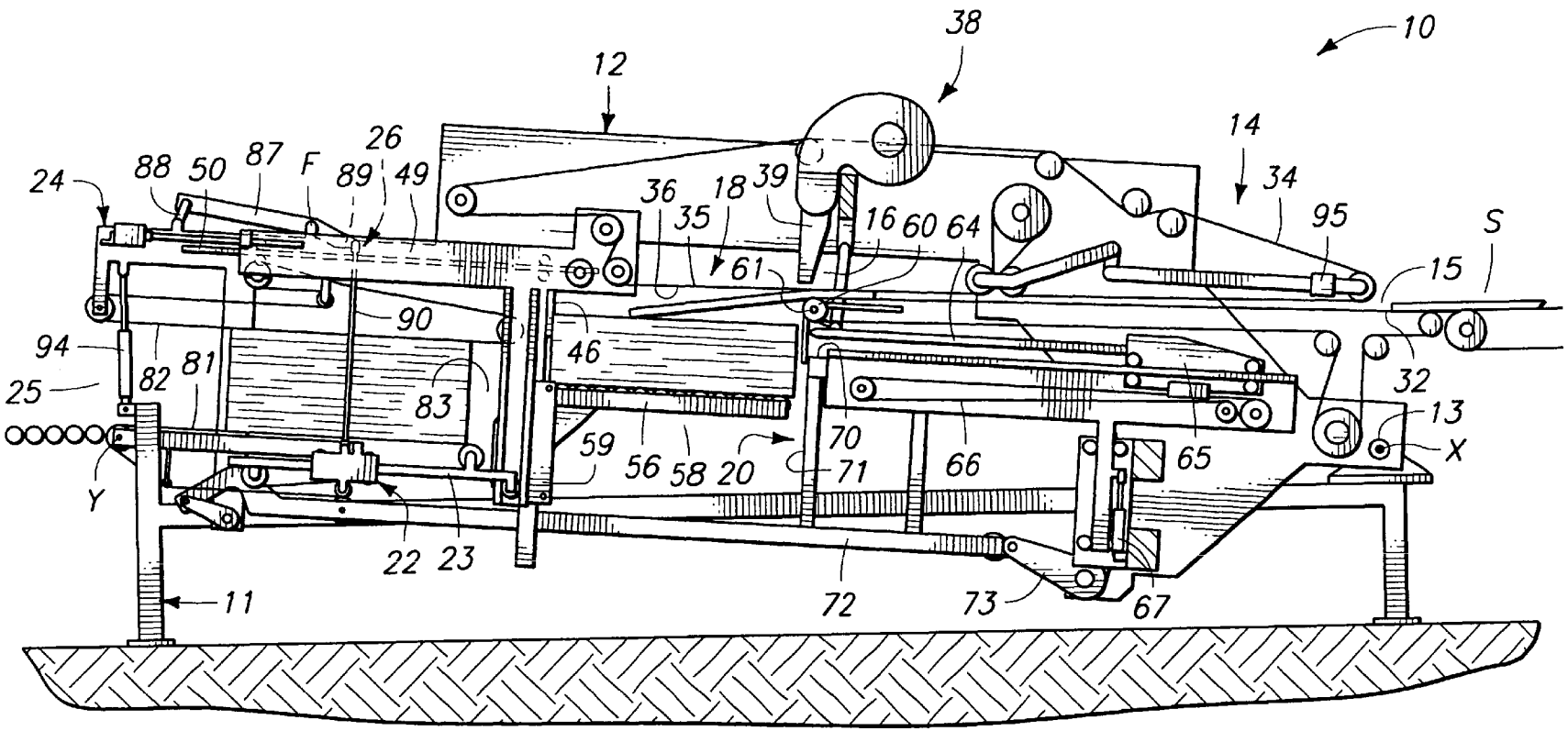
FIG. 3 is a side elevation view of the counter-ejector with the housing removed, the view being simplified to more clearly show various operational components.

Preferred forms of the present counter-ejector 10 include a base frame 11 that is intended to be mounted to a crawl frame or a fixed floor surface. The exemplified base frame 11 is elongated, extending from the discharge of a sheet feed S (FIGS. 2, 3) from a sheet forming or finishing machine that does not comprise part of the present invention. It is preferable that the base frame 11 extend along the approximate length of the counter-ejector 10 to an end adjacent the stack discharge 25. The base frame 11 is preferably fixed and stationary in relation to the main frame 12, and compression frame 23.

The exemplary main frame 12 is mounted to the base frame 11 for pivotal motion about the pivot axis X, which is preferably situated adjacent the infeed end 15 of infeed conveyor 14. The pivot axis X may be defined by a hinge 13 (FIG. 3) that pivotably interconnects the main and base frames 12, 11 so the downstream end of the main frame 12 (adjacent the stack discharge 25) may be pivoted elevationally.

Main frame 12 is preferably rigid along its length to provide support for the infeed conveyor 14, which is preferably mounted on the main frame with the infeed end 15 situated adjacent the pivot axis X. Thus, the main frame 12 and infeed conveyor 14 may pivot about the axis X without significantly changing the elevation of the conveyor infeed end 15 with respect to the sheet feed S. This means that the sheet materials may be fed into the present counter-ejector at a relatively fixed elevation, regardless of the pivoted angle of the main frame 12 about the pivot axis X.

The infeed conveyor 14 is preferably powered by conventional electric, hydraulic or pneumatic drive to receive sheet articles in end-to-end relation from an upstream source. The term "end-to-end" should be understood to mean that the sheet materials are organized to follow one another along the forward path of travel, and that the sheet ends may be spaced apart along the path as shown, or in abutment with one another but preferably not overlapping in a shingled fashion.

Preferred forms of the conveyor 14 include the sheet transport flight 32, and the hold down flight 36. Both flights 32 and 36 are powered by conventional electric, hydraulic, or pneumatic motors to move sheet materials in the forward path of travel (right to left in FIG. 3). The hold down conveyor 34 positions the hold down flight 36 at a selected elevational distance from the transport flight 32, to accommodate the thickness dimensions of sheet materials, and to hold the sheets in a somewhat compressed state while they move from the infeed end 15 to the discharge end 16. This is done to hold the sheets in their formed condition and to allow drying time for glue that may have been applied to portions of the sheets.

In a preferred form, the hold down conveyor 34 extends beyond the discharge end 16 of the infeed conveyor 14 to substantially overlap the stack forming magazine 18. This is done to at least partially cover the magazine 18, and to prevent the leading edges of sheet materials being discharged from the infeed conveyor 14 from lifting upwardly before striking the back stop 46.

The preferred hold down conveyor includes a hold down belt 35 with blow down air holes 37 (FIG. 10) that are formed therein. A blower 38 is connected to discharge nozzles 39 that are preferably located along the forward path of travel downstream of the discharge end 16 and over the hold down belt 35 and stack forming magazine 18. The nozzles are oriented to blow air downwardly through the blow down holes 37 toward the magazine.

The nozzles 39 are preferably located to direct air jets downwardly (through the holes 37) at a location just slightly downstream of the discharge end 16 in order to blow the leading and trailing edges of successive sheets downwardly toward the magazine. The holes 37 allow the air jets to pass downwardly through the hold down belt 35 as the belt moves past the nozzles 39. Thus, the belt 35 may be used to cover the stack forming magazine 18, to prevent the leading edges of sheets from lifting upwardly, and to provide passage for the downward air jets directed through nozzles 39. Substantially positive control of the sheets is thus maintained after they leave the discharge end of the infeed conveyor.

Successive sheets leaving the discharge end of the infeed conveyor 14 are projected by forward momentum across the magazine to a point where the leading edges strike the back stop 46 which is located along side of the sheet stacking magazine 18. The back stop 46 is preferably a flat plate that is mounted to a back stop frame 49 that is adjustable along longitudinal rails 50 provided on the main frame 12. The back stop frame 49 will thus move up or down with the frame 12 about the pivot axis X, or longitudinally along the frame to adjust for sheets of different length. The back stop frame 49 may be adjusted by operation of conventional means (FIG. 4) such as linear actuators, hydraulic cylinders, gearmotors, or the like; mounted between the main frame 12 and back stop frame 49. In such longitudinal adjustment the back stop 46 may be moved toward or away from the infeed conveyor discharge end, along with other elements described below, that simultaneously adjust to accommodate various sheet sizes.

Figure 17:
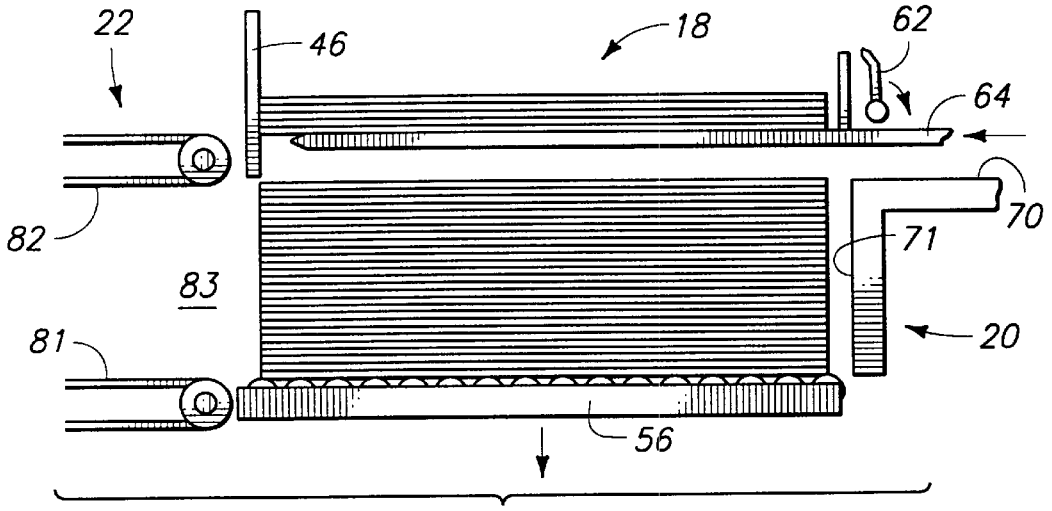
FIG. 17 is a schematic operational view showing extension of the separator forks, retraction of the catch pins, and continued downward movement of the lift platform to a position ready for operation of the ejector.

The lift platform 56 may also be mounted to the back stop frame 49 below the back stop 46 so the platform 56 and back stop 46 can both be adjusted simultaneously to accommodate sheet materials of different lengths. The lift platform 56 is also preferably elevationally movable on the back stop frame 49 by way of a substantially upright carriage 59. The lift platform 56 may be controlled to index progressively downward according to the sheet count as a stack is formed to lower from an initial upward position (FIG. 15) to a lowered position (FIG. 17) where the ejector 20 is operable to shift the formed stack from the lift platform 56 to the stack compressor 22.

A tamper 60 (FIG. 3) is situated on a side of the magazine 18 that is substantially directly below the discharge end 16 of the infeed conveyor. The tamper may be operated continuously to bump the trailing edges of sheet materials received within the magazine 18 to keep the forming stacks uniform. The tamper may be operated by an eccentric drive 61 on the main frame 12.

Figure 19:
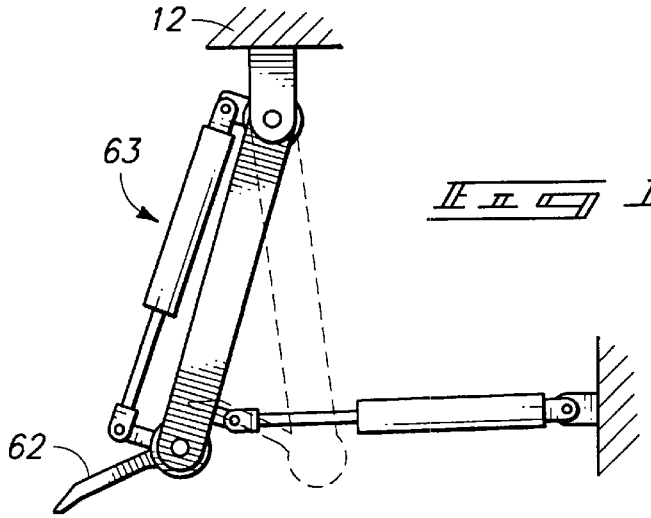
FIG. 19 is a fragmented detail view of the catch pin assembly, with an extended catch pin position shown in solid lines and a retracted position shown in dashed lines.

Catch pins 62 (detailed in FIG. 19) may be provided on the main frame 12 adjacent the tamper 60 and the discharge end 16 of the infeed conveyor. The catch pins 62 may be actuated to create an opening between selected successive sheets accumulating in the stack forming magazine 18 for reception of a set of separator forks 64 (described below).

Figure 16:
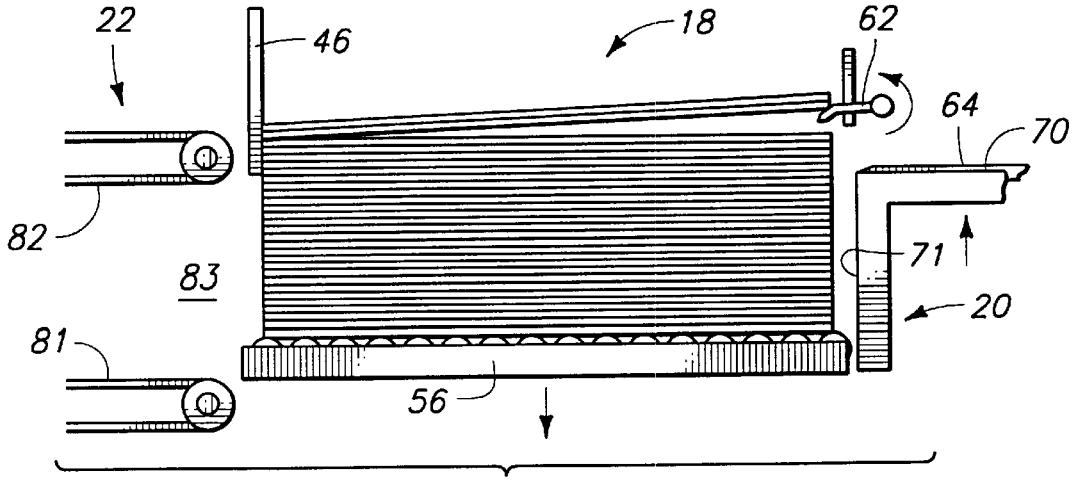
FIG. 16 is a schematic operational view showing a complete sheet count in a stack on the lift platform and operation of catch pins to provide space to receive the separator forks between the top of the stack and more accumulating sheets.

The catch pins 62 are preferably moved in an arcuate reciprocating path by the exemplary cylinder actuated linkage 63. The catch pins 62 may thus be shifted between a starting position (dashed lines in FIG. 19) clear of the magazine 18 and a sheet trailing edge catching position (solid lines in FIG. 19) projecting into the magazine 18. When the pins 62 are in the starting position, trailing edges of sheets will be free to move downwardly into the magazine 18. When the catch pins 62 are shifted into the magazine 18, trailing edges of sheets above the pins 62 will be held above the stack below (see FIG. 16).

The successive stacks of sheet materials are temporarily supported on separator forks 64 that are mounted for reciprocating movement on the main frame 12. The separator forks 64 are operated intermittently to support an accumulating stack while the ejector 20 is being operated to remove a previously accumulated stack from the lift platform, and to allow time for the lift platform 56 to be elevated from the lowered position adjacent the stack compressor 22 following operation of the ejector 20.

In a preferred form, the separator forks 64 are mounted for substantially vertical and horizontal motion by way of a lift carriage 65, and a horizontal drive 66 (FIG. 3) that are both mounted to the main frame 12. The separator forks 64 and carriage 65 will thus pivot with the main frame 12 about the pivot axis X.

Figure 11:
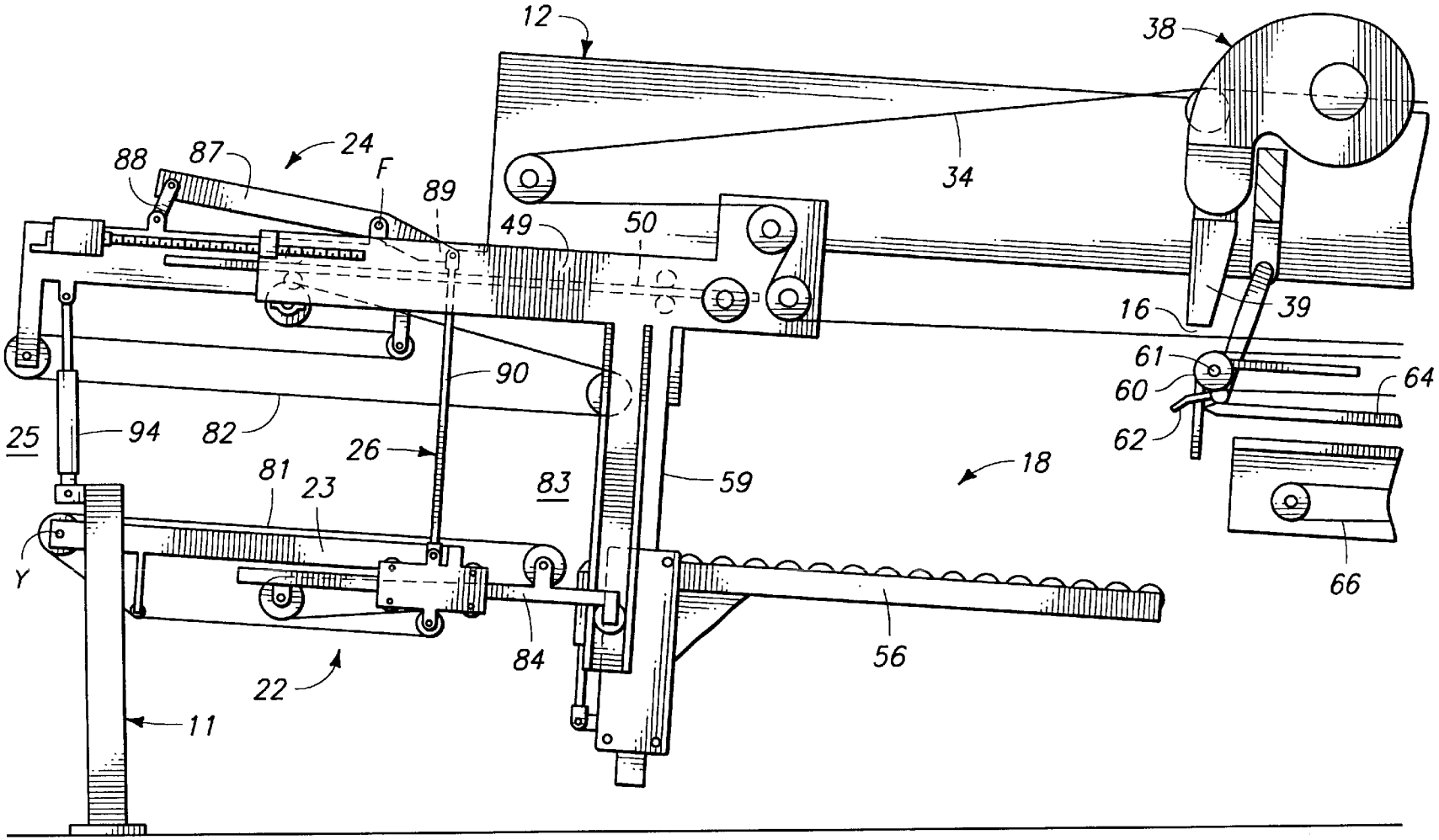
FIG. 11 is a schematic operational view showing the relationship between the separator forks and the ejector as sheets accumulate on the separator forks.
Figure 11:
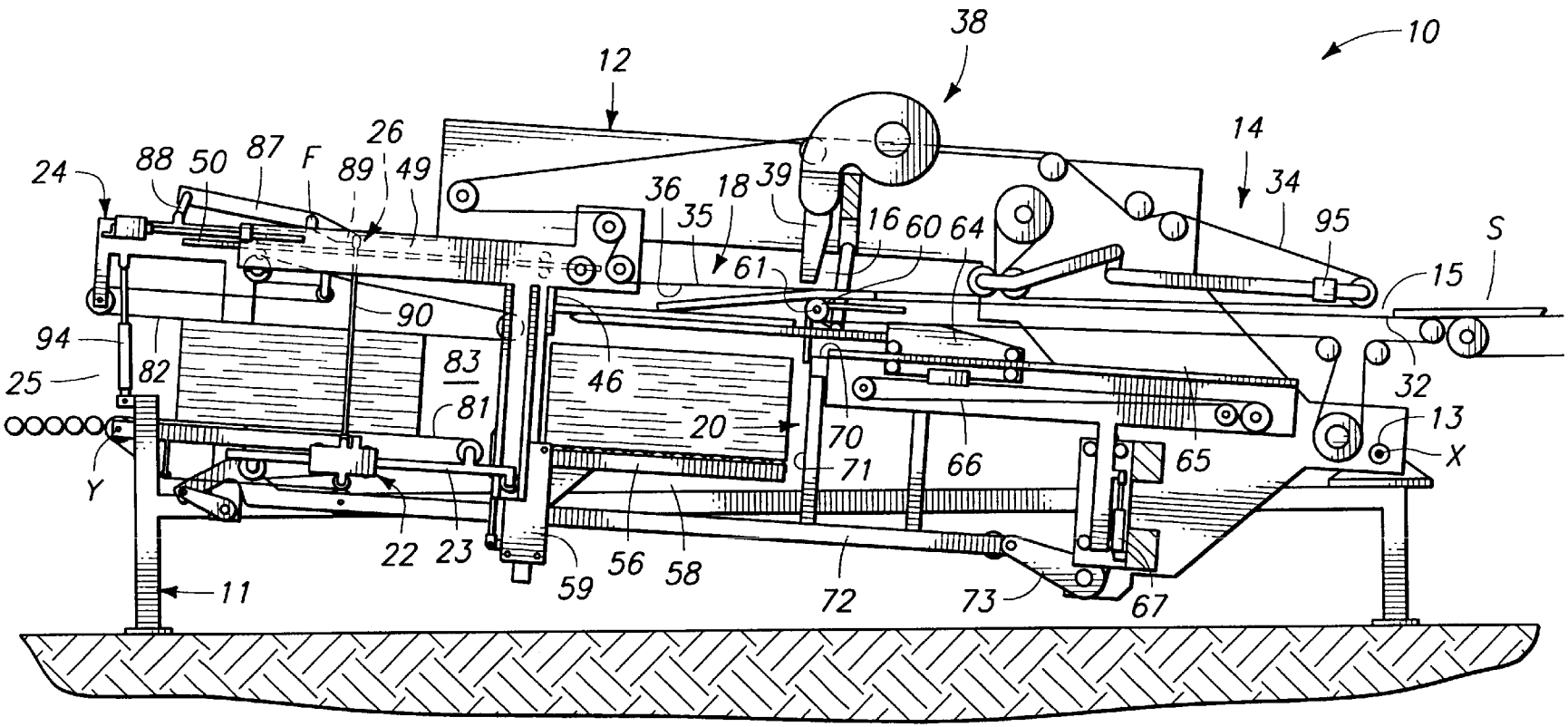
Figure 6:
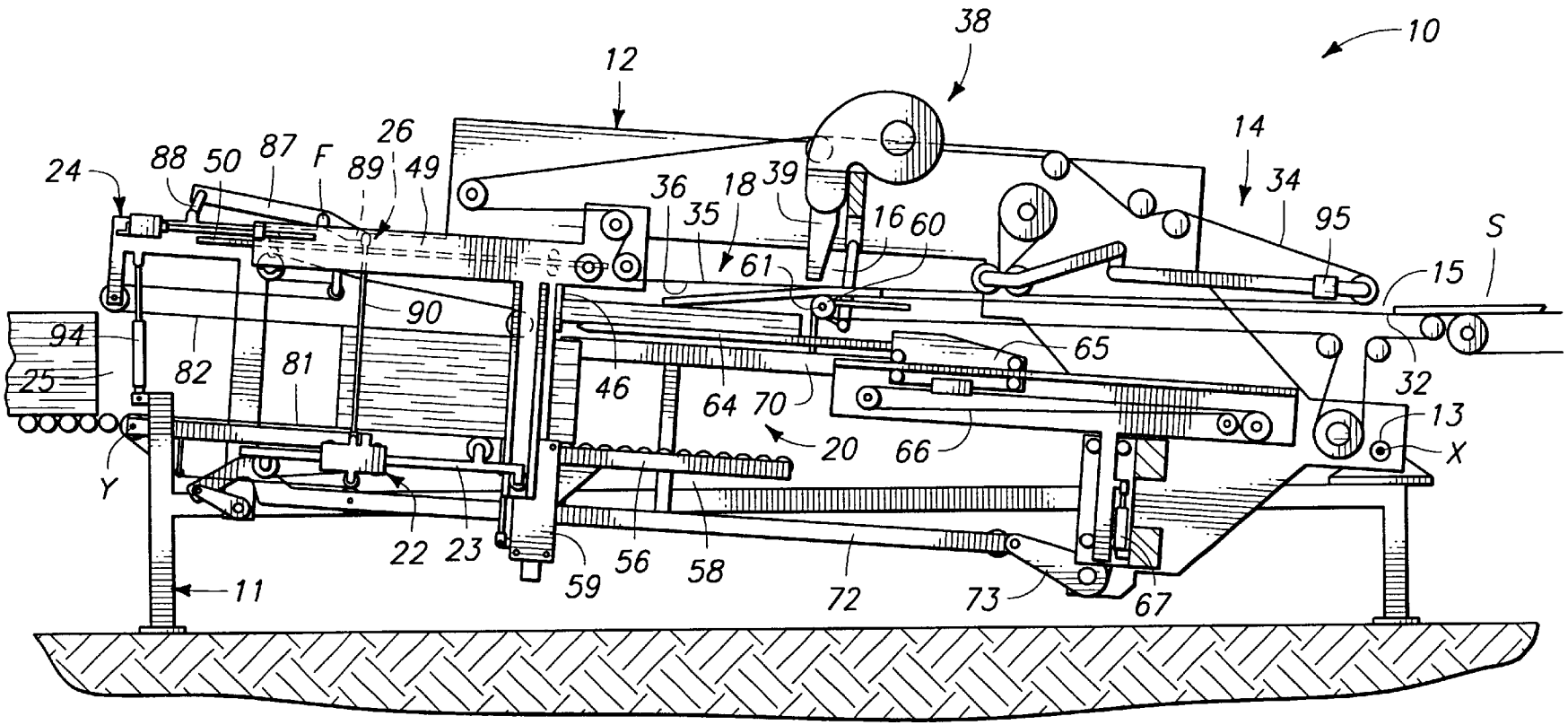
FIG. 6 is a view similar to FIG. 5 only showing discharge of the stack into the compressor and continued accumulation of sheets on the separator forks.

The separator forks 64 are moved by the carriage 65 and horizontal drive 66 in a substantially rectangular path of movement. The horizontal drive 66 operates for move the forks in a forward stroke starting from an initial position under the infeed conveyor 14 (FIG. 3) to a position spanning the sheet stacking magazine 18 (FIG. 11) above the lift platform 56. A cylinder or other lift device 67 may be provided on the lift carriage 65 to raise and lower the separator forks 64 within the magazine 18 to allow accumulation of sheets on the forks. The horizontal drive 66 may be operated also to withdraw the separator forks 64 (in the lowered position) to deposit the accumulating sheets onto a shelf 70 of the ejector 20. The forks 64 may be withdrawn in the lowered condition, back to the position under the infeed conveyor 14 where they are elevated once again to the starting position.

The preferred ejector 20 functions to shift successive formed stacks from the lift platform 56 and into the stack compressor 22. The preferred ejector also operates to provide intermediate support (by way of shelf 70) of an accumulating stack after the separator forks are withdrawn and until such time that the empty lift platform 56 can be raised to receive the next accumulating stack.

To accomplish the above functions, the exemplified ejector 20 may include an upright pusher frame 71 that mounts the shelf 70 at an upper end thereof. The pusher frame 71 and shelf 70 are mounted on an ejector carriage 72 that is driven to reciprocate between a position under the infeed conveyor, and a position where the shelf 70 spans the stack forming magazine 18. In the example illustrated, the ejector carriage 72 and ejector 20 are mounted to a parallelogram lift 73 which is selectively operable to lift and lower the ejector 20. Thus, the ejector 20 may also be moved in a substantially rectangular path.

It is pointed out that in preferred forms, the parallelogram lift 73 is mounted to the main frame 12 so the ejector 20 will pivot with the frame about the pivot axis X.

The stack compressor 22 is positioned to receive successive stacks from the ejector. In preferred forms, the stack compressor includes the compressor frame 23 that is pivotably mounted to the base frame 11 for pivotal movement about the compression axis Y. The preferred stack compressor 22 includes a stack bottom engaging conveyor 81 that may be spaced elevationally below a stack top engaging conveyor 82 that is mounted to the main frame 12.

It is preferred that the stack bottom and stack top engaging conveyors 81, 82 receive stacked sheet articles at a stack infeed end 83 and deliver the stacked sheet articles to the stack discharge 25. The infeed end 83 is situated adjacent the magazine 18, with the stack bottom engaging conveyor 81 situated elevationally even with the bottom position of the lift platform 56. Both conveyors may be driven to compress and move successive stacks from the stack infeed end 83 through the stack discharge 25.

In the example illustrated, it is noted that the stack top engaging 82 conveyor is mounted to the main frame 12 and will thus pivot with the main frame about the pivot axis X. The stack bottom engaging conveyor 81, on the other hand, is preferably pivotably mounted by way of the stack compression frame 23 to the base frame 11. The discharge end of the stack bottom engaging conveyor 81 is preferably coaxial with the axis Y. The discharge end of the stack bottom conveyor 81 may therefore remain at a substantially fixed elevation regardless of the spacing between the stack bottom and top engaging conveyors 81, 82.

It is noted at this point that both ends of the present counter-ejector are substantially elevationally fixed. That is, the infeed end 15 of the infeed conveyor is substantially elevationally stationary, and the stack discharge 25 is similarly substantially elevationally stationary. This arrangement is preferred to avoid the need to make elevational adjustments in upstream equipment that feeds sheets to the counter-ejector, and in downstream equipment that receives stacks of sheets from the counter-ejector. This is substantially a function of the pivot axis X and compression axis Y which are fixed with respect to one another and are situated adjacent the infeed conveyor and stack compressor respectively.

As generally noted above, the preferred compression linkage 24 joins the stack compressor 22 and main frame 12, with links 26 arranged to adjustably open and close the stack compressor responsive to movement of the main frame about the pivot axis X. The term "open" as used herein relates to spacing between the stack bottom and top engaging conveyors 81, 82 when the free end of the stack bottom engaging conveyor 81 is pivoted downwardly about the compression axis Y. The term "close" relates to spacing between the stack top engaging conveyor 82 and the stack bottom engaging conveyor 81 when the free end of the stack bottom engaging conveyor 81 is pivoted upwardly about the compression axis Y. Opening or closing the compressor 22 is accomplished to accommodate stacks of differing heights.

Both of the stack bottom and top engaging conveyors 81 and 82 are preferably adjustable longitudinally with respect to the forward path of travel for the sheets moving on the infeed conveyor. The top conveyor 82 is connected at one end to the back stop frame 49. The infeed end of the top conveyor 82 may thus be adjusted up and down, and along the main frame simultaneously with adjustments of the back stop 46, hold down conveyor 34, and lift platform 56 to accommodate sheets of different length dimension (measured along the path of travel). The bottom conveyor 82 may also have its forward end mounted to the back stop frame 49 for simultaneous adjustment capability with the back stop 46, lift platform 56, and hold down conveyor 34.

The forward end of bottom conveyor 82 may be mounted to a slide adjustment 84 (FIG. 4) that can be connected by roller followers to the back stop frame 49. Horizontal adjustment of the back stop frame 49 (as discussed above) will thus result in similar and simultaneous adjustable positioning of the bottom engaging conveyor infeed end. The roller followers will also allow for pivoted elevational travel of the bottom conveyor end (about the compressor pivot axis Y) in response to movement of the main frame about the pivot axis X and consequent action of the compression linkage 24.

The compression linkage 24 is linked between the main frame 12 and the stack bottom engaging conveyor 81 to translate pivotal motion of the main frame to open and closing action of the stack compressor 22, thereby adjusting for selected stack height. The linkage 24 may be arranged with three fixed pivot points, one of which defines the pivot axis X and the second of which defines the compression axis Y. A third fixed pivot point F is provided between the base frame 11, which is a fulcrum point for a rocker arm 87, which is an element of the links 26.

The exemplified rocker arm 87 is pivoted at pivot point F between one end which is connected by a link 88 to the main frame 12 and a remaining end 89. A pitman 90 may be used to connect the remaining end 89 of rocker arm 87 and the stack bottom engaging conveyor 81.

It is preferred that the stack bottom engaging conveyor 81 remain parallel to the stack top engaging conveyor 82 regardless of the adjusted opening size between the two. This is accomplished with the exemplary three fixed pivot points, by equating the ratio of the distance (labeled A in FIG. 7) from the first pivot axis X to the connecting point for the link 88 to the distance (labeled B in FIG. 7) from axis Y to the point of connection on the compression frame 23, and the distance (labeled C in FIG. 7) from the point of contact by the link 88 to the axis F to the distance (labeled D in FIG. 7) from axis F to the remaining end 89 of the rocker where the pitman 90 is connected. Thus, using the distances labeled in FIG. 7, A/B=C/D.

Figure 7:
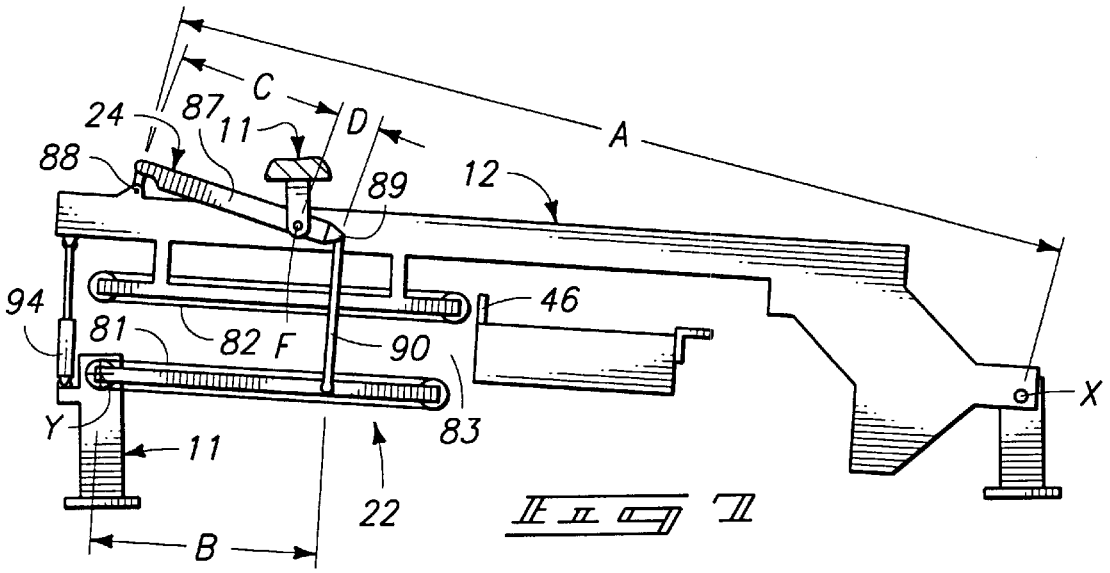
FIG. 7 is a schematic view illustrating a first open position of the compressor for receiving a sheet stack of a first height.
Figure 8:
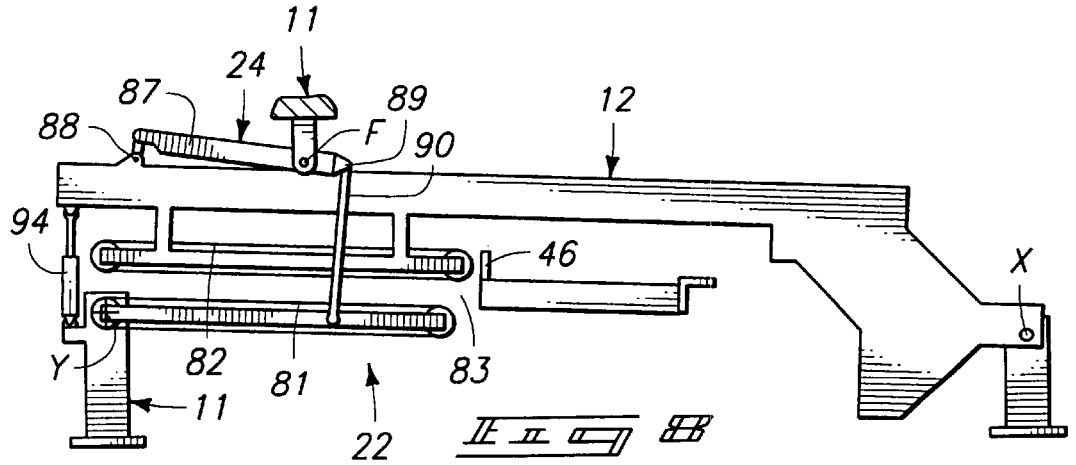
FIG. 8 is a schematic view similar to FIG. 7 only showing the compressor at an intermediate position for receiving a sheet stack of a medium height.
Figure 9:
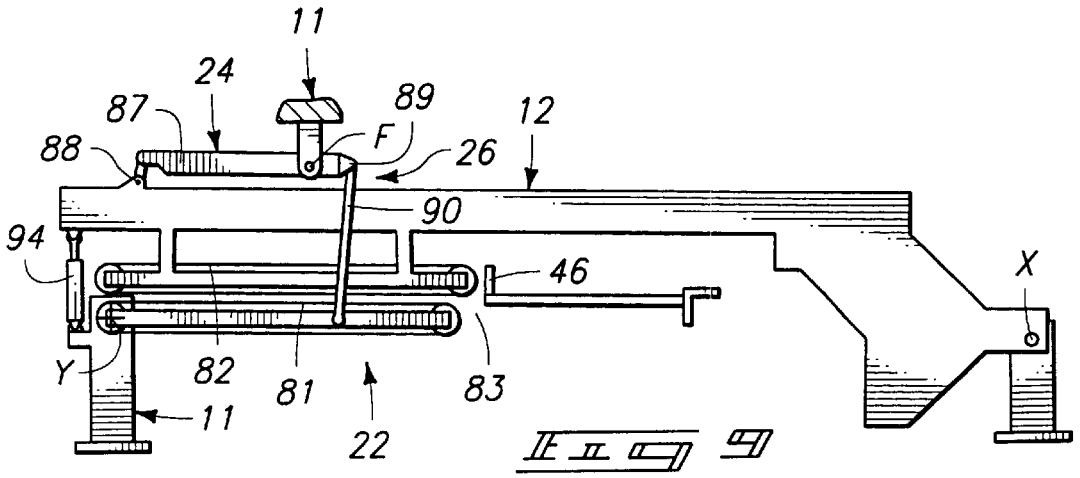
FIG. 9 is a schematic view similar to FIG. 8 only showing the compressor at an closed position for receiving a sheet stack of a minimum height.
Figure 11:
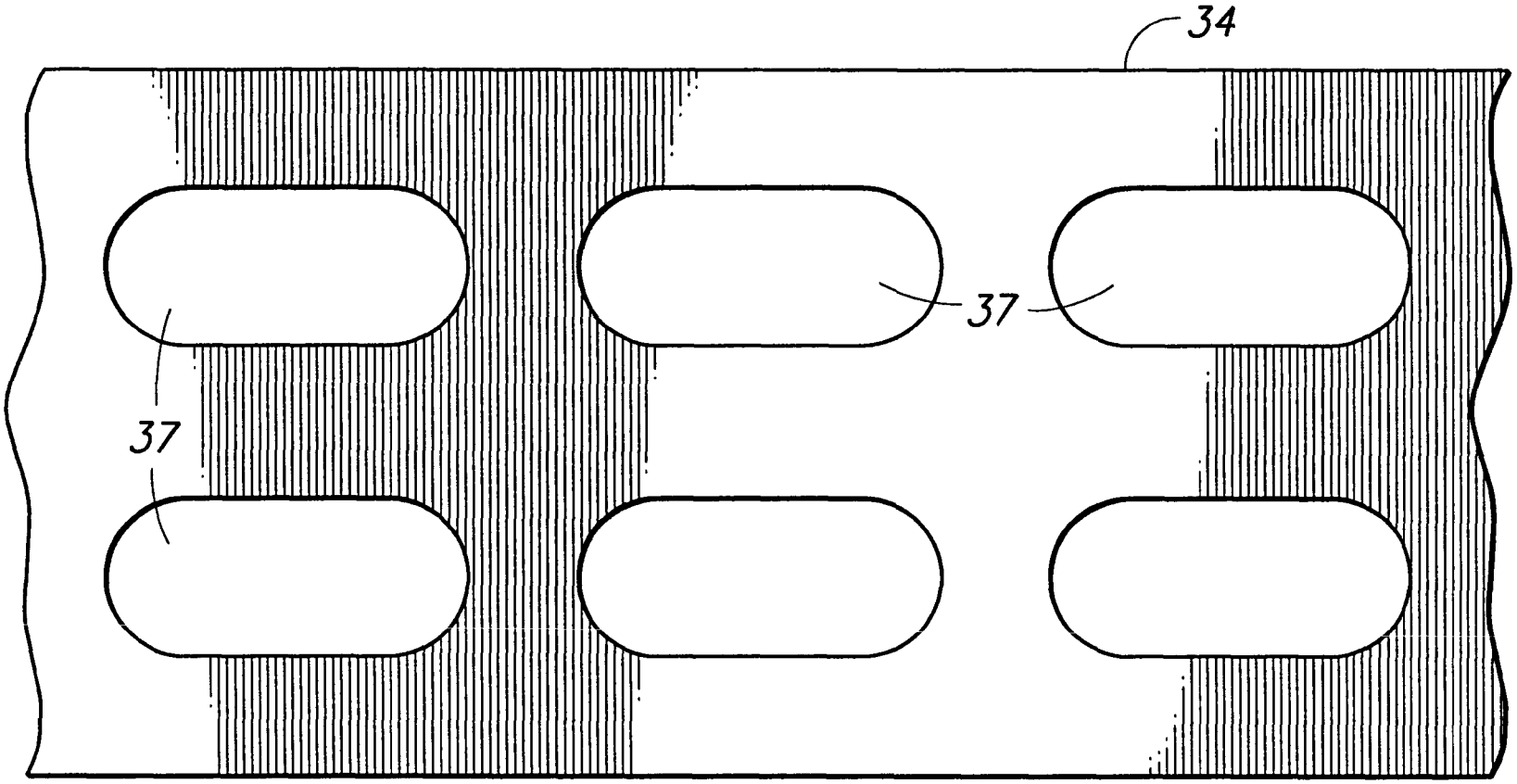
Figure 11:
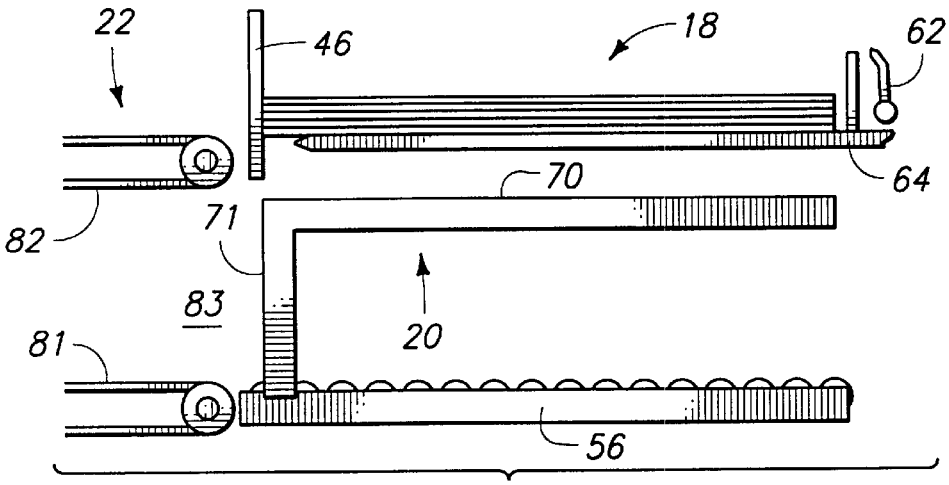
Figure 12:
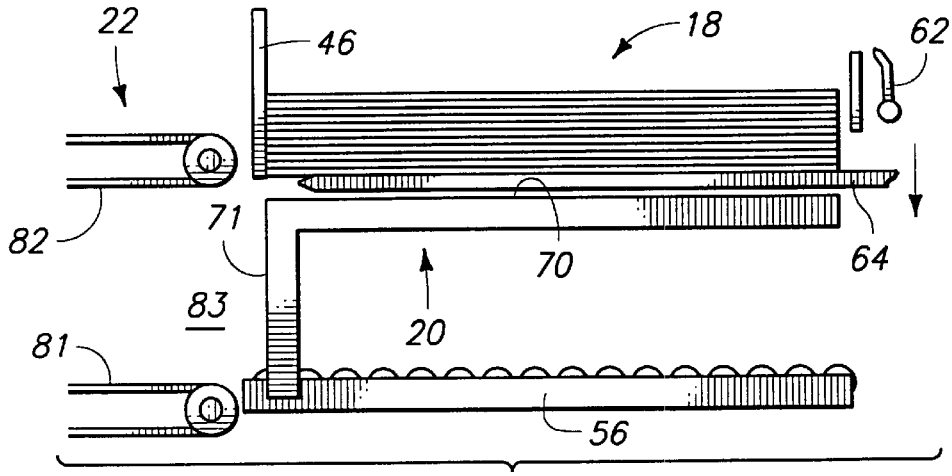
FIG. 12 is a schematic operational view showing the separator forks being lowered as more sheets accumulate.

The result of the above relationships is demonstrated in FIGS. 7–9. In FIG. 7, the compression conveyors 81, 82 are spaced apart to accept a maximum size stack of sheets, yet the working flights of the two conveyors 81, 82 are parallel. In FIG. 8, the compression conveyors are set to receive a medium height stack, and still the conveyors are parallel. The same parallel relationship is also true as demonstrated in FIG. 9 where the two conveyors are spaced apart to receive a stack of minimal height. Such adjustments are possible without changing the positions of axes X, Y, or F, all of which remain fixed.

The above adjustments may be made by operation of a lift 94 that may be mounted between the main frame 12 and the base frame 11, preferably adjacent the stack compressor 22. In the preferred example shown, extension of the lift 94 will elevate the main frame 12 upwardly about the first pivot axis X. The elements mounted to main frame 12 will also pivot upwardly, including the stack top engaging conveyor 82, and the stop 46. The rocker 87, being pivoted at the fixed point F will rock downwardly at the remaining end 89, lowering the pitman 90 and pivoting the bottom stack engaging conveyor 81 downwardly. The distance between the stack bottom engaging conveyor 81 and stack top engaging conveyor 82 is thus increased and, with the above relationship, parallelism is maintained between the two. The reverse is true when the lift is retracted; the two conveyors 81, 82 will be adjusted toward one another, yet remain parallel.

Operation of the preferred counter-ejector will be described beginning with initial adjustments for a stack of sheet materials with certain hypothetical characteristics. Let us assume that the sheet material to be stacked is comprised of folded box blanks having a length dimension (measured along the forward path of travel through the counter-ejector) of, say 30 inches. Let us also say that each blank has a thickness dimension measured vertically of 0.5 inches. And further, let us say the successive formed stacks are to each contain 20 sheets. The resulting stack will thus have a height of approximately 10 inches (20×0.5).

The counter-ejector 10 is thus adjusted using appropriate controls to count, stack, and eject stacks of 20 sheets, with each stack being 30 inches long and approximately 10 inches in height.

Adjustment is made for the stack length by shifting the back stop frame 49 and the elements mounted thereto (specifically the stop 46, lift platform 56, and the stack infeed end of the stack compressor 22) to effectively open the magazine to receive 30 inch sheets. This is done by moving the back stop frame to a position where the distance between the stop 46 and the sheet discharge end 16 of infeed conveyor 14 is slightly greater than 30 inches. The components mounted to the back stop frame 49 adjust along with the back stop frame, without requiring additional operations.

Adjustment is made also for the stack height by operating the lift 94 to raise or lower the main frame 12 about axis X and cause corresponding adjustment of the opening between the stack bottom and top engaging conveyors 81, 82, to slightly less than 10 inches. This is accomplished by way of the links 26 which translate pivotal motion of the main frame 12 to responsive pivotal motion of the stack bottom conveyor 81 about axis Y as explained above. It is noted that the components mounted to the main frame (including the stop 46) will also pivot with the main frame during stack height adjustment, so no further adjustments are required.

Once both of the above adjustments are made, operation of the counter-ejector may be initiated. The sheets are fed into the infeed conveyor 14 in end-to-end relation and are passed along in the forward path of travel to the infeed conveyor discharge end 16 where they are successively deposited into the stack forming magazine 18. The sheets may be slightly compressed in transit by action of the hold down conveyor 34, and be maintained in a downward trajectory by the extent of the hold down conveyor that overlaps or spans the magazine 18, and by the jets of air directed downwardly against the sheets by the blower 38.

Successive sheets are discharged from the infeed conveyor into the stack forming magazine 18 where they accumulate until the prescribed number of sheets (20) is received. The sheet count may be sensed by a counting device 95 mounted along the main frame to count successive sheets as they enter the infeed conveyor 14.

FIGS. 11–18 graphically exemplify formation of a sheet stack within the stack forming magazine 18 and subsequent discharge of the stack. Each sheet leaves the infeed conveyor at the sheet discharge end 16. Forward momentum carries the sheet forwardly and downward until the leading edge strikes the stop 46. By now the sheet has left the infeed conveyor and is free to drop onto the stack below. Downward jets of air from the blower 38 (FIGS. 3, 4) pass through the air holes 37 in the hold down conveyor to force the sheet down into the magazine.

Figure 13:
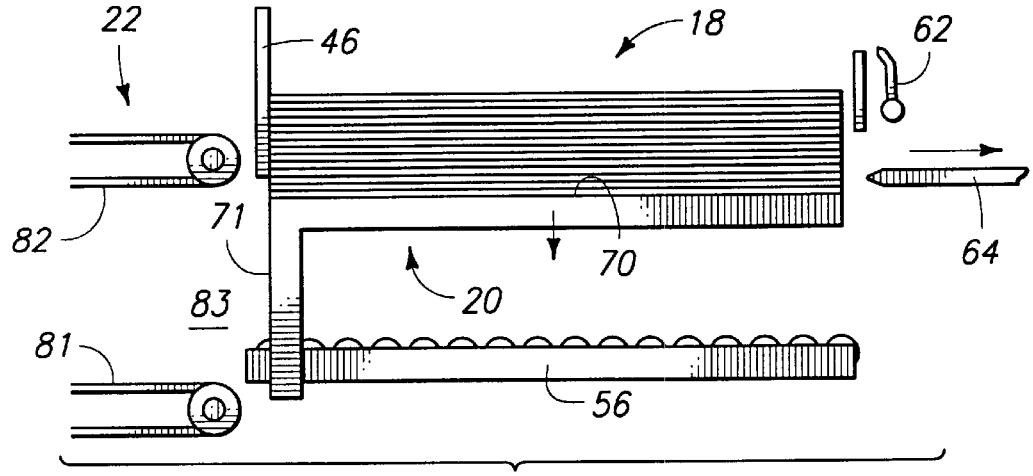
FIG. 13 is a schematic operational view showing retraction of the separator forks to strip the accumulated sheets onto the ejector, and subsequent downward motion of the ejector.
Figure 14:
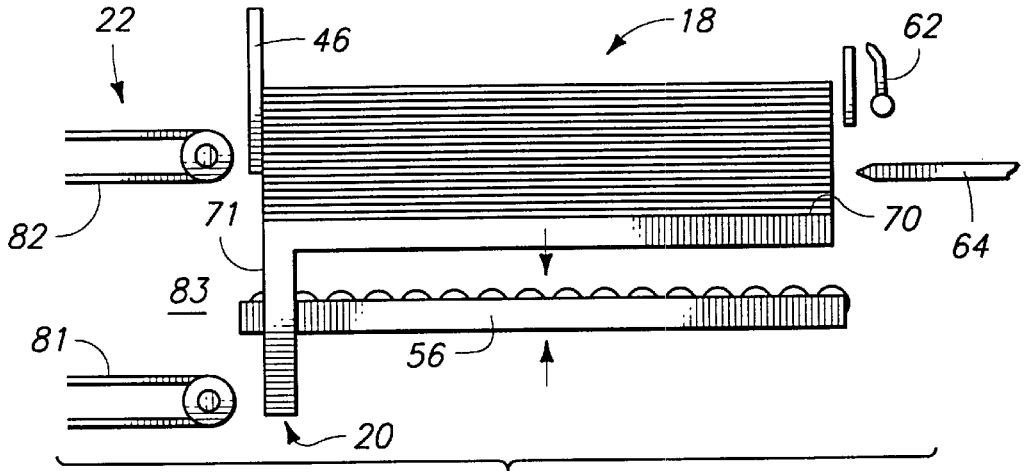
FIG. 14 is a schematic operational view showing downward motion of the ejector and upward motion of a lift platform to receive the accumulating sheets therefrom.
Figure 15:
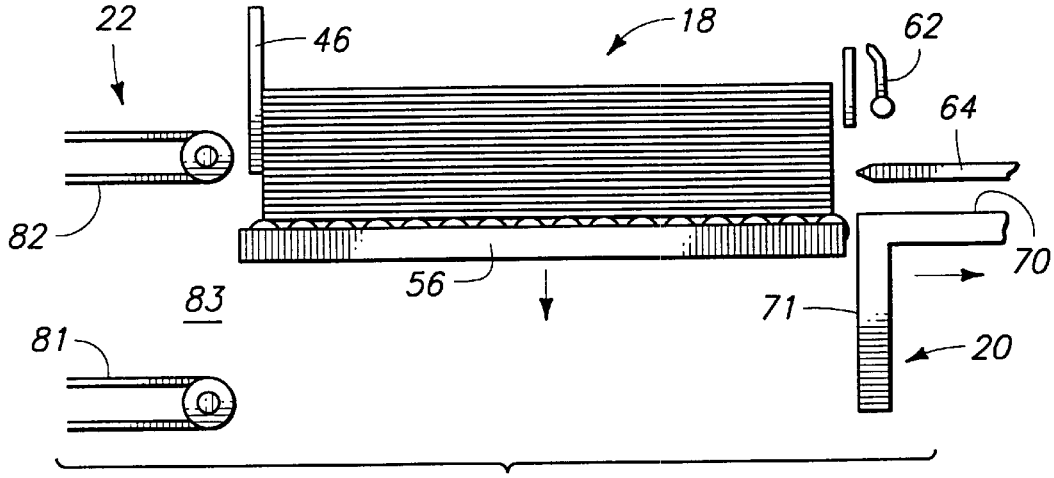
FIG. 15 is a schematic operational view showing retraction of the ejector and reception of the accumulating stack on the lift platform.

The first several sheets of the stack are received on the separator forks 64 (FIG. 11), which are progressively lowered as sheets accumulate (FIG. 12) until they reach the level of the ejector shelf 70. The descending forks then retract to strip the accumulated sheets onto the ejector shelf 70 (FIG. 13). The ejector shelf 70 is now lowered progressively while the lift platform 56 moves upwardly (FIG. 14). The ejector shelf continues downward and the lift platform continues moving upwardly until such point that the accumulating stack is received by the lift platform 56 (FIG. 15). At this time the ejector 20 is retracted to a position below the retracted lift forks, and the lift platform begins to move downwardly until the full sheet count is received.

As the last sheet is received, completing the count, the lift platform will be approaching the preset level of the stack bottom engaging conveyor. The catch pins 62 are now shifted into the magazine to intercept the downward flow of additional sheets that will make up the next successive stack.

The catch pins 62 create a space (FIG. 16) that will allow insertion of the separator forks 64 (FIG. 17), which have been previously elevated back to the starting position.

Figure 18:
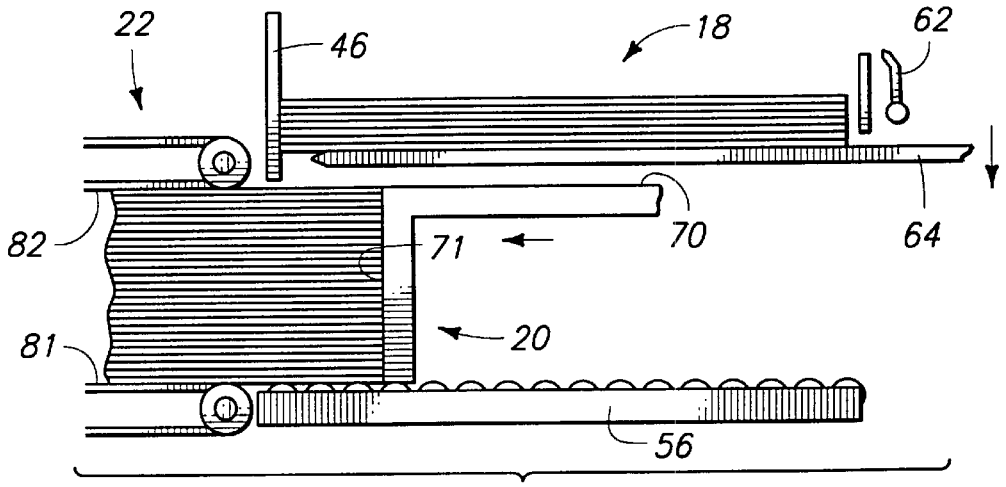
FIG. 18 is a schematic operational view showing extension of the ejector to shift the stack from the lift platform and into the compressor, as the separator forks lower with further accumulating sheets.

As more sheets accumulate on the separator forks 64, the ejector is operated to move across the magazine, engaging the stack with the pusher 71 and pushing the stack from the lift platform and into the stack compressor (FIG. 18). The stack compressor operates to compress and move the stack to the stack discharge 25. The ejector 20 and separator forks 64 are now in the starting position shown in FIG. 11 where another stacking cycle begins.

It is noted that the present counter-ejector may continue in the above operation without interrupting sheet flow and that the adjustments mentioned above are accomplished without requiring repositioning of upstream or downstream equipment.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A counter-ejector for stacking relatively flat sheet articles, comprising: a base frame;

a main frame selectively movable on the base frame about a pivot axis;

an infeed conveyor on the main frame defining a forward path of travel for sheet articles;

the infeed conveyor including a discharge end positioned adjacent a stack forming magazine where individual sheet articles from the infeed conveyor accumulate in a stack;

an ejector adjacent the stack forming magazine and movable across the stack forming magazine from a stack engaging position adjacent the stack forming magazine to a shifted position at a stack compression station;

a stack compressor at the stack compression station and positioned to receive a stack of sheet articles from the ejector; and a compression linkage joining the stack compressor, main frame, and base frame with links arranged to adjustably open and close the stack compressor responsive to movement of the main frame about the pivot axis.

2. A counter-ejector for stacking relatively flat sheet articles, as defined by claim 1 wherein the stack compressor pivots on a compression axis in response to movement of the main frame about the pivot axis.

3. A counter-ejector for stacking relatively flat sheet articles, as defined by claim 1 wherein the infeed conveyor includes an infeed end and wherein the pivot axis is situated adjacent the infeed end.

4. A counter-ejector for stacking relatively flat sheet articles, as defined by claim 1 wherein the stack compressor pivots on a compression axis in response to movement of the main frame about the pivot axis and wherein the pivot axis and compression axis are fixed with respect to one another and are situated adjacent the infeed conveyor and stack compressor respectively.

5. A counter-ejector for stacking relatively flat sheet articles, as defined by claim 1 wherein the main frame is pivoted by a lift situated adjacent the stack compressor.

6. A counter-ejector for stacking relatively flat sheet articles, as defined by claim 1 wherein the feed conveyor is powered to receive sheet articles in end-to-end relation.

7. A counter-ejector for stacking relatively flat sheet articles, as defined by claim 1 wherein the compressor includes a stack infeed end and a stack discharge; and wherein the stack infeed end is adjustable longitudinally with respect to the forward path of travel.

8. A counter-ejector for stacking relatively flat sheet articles, as defined by claim 1 further comprising:

a stack top engaging conveyor adjacent to the stack forming magazine;

wherein the compressor includes a stack bottom engaging conveyor spaced elevationally below the stack top engaging conveyor;

wherein the stack bottom and top engaging conveyors receive stacked sheet articles at a stack infeed end and deliver the stacked sheet articles to a stack discharge; and wherein the compression linkage is linked between the main frame and the stack bottom engaging conveyor.

9. A counter-ejector for stacking relatively flat sheet articles, comprising: a fixed base;

a main frame on the base selectively movable about a pivot axis;

an infeed conveyor on the main frame defining a forward path of travel for sheet articles from an infeed end adjacent the pivot axis;

the infeed conveyor including a discharge end positioned adjacent a stack forming magazine where individual sheet articles from the infeed conveyor accumulate in a stack;

an ejector adjacent the stack forming magazine and movable across the stack forming magazine from a stack engaging position adjacent the stack forming magazine to a shifted position at a stack compression station;

a compression frame on the base and pivotable thereon about a compression frame axis adjacent a stack discharge spaced downstream from the pivot axis with respect to the forward path of travel;

a stack compressor including the compression frame at the stack compression station, positioned to receive a stack of sheet articles from the ejector; and a compression linkage joining the compression frame and main frame, with links arranged to adjustably open and close the stack compressor responsive to relative pivotal movement of the main frame and compression frame about the pivot axis and the compression frame axis respectively.

10. A counter-ejector for stacking relatively flat sheet articles, as defined by claim 9 wherein the compression axis and pivot axis are substantially parallel and transverse to the forward path of travel.

11. A counter-ejector for stacking relatively flat sheet articles, as defined by claim 9 wherein the compression axis and pivot axis are fixed with respect to one another.

12. A counter-ejector for stacking relatively flat sheet articles, as defined by claim 9 wherein the main frame is pivoted by a lift situated adjacent the stack compressor.

13. A counter-ejector for stacking relatively flat sheet articles, as defined by claim 9 wherein the infeed conveyor is powered to receive sheet articles in end-to-end relation.

14. A counter-ejector for stacking relatively flat sheet articles, as defined by claim 9, further comprising:

a stack top engaging conveyor on the main frame and spaced adjacent the stack forming magazine;

wherein the stack compressor is comprised of a stack bottom engaging conveyor on the compression frame positioned elevationally below the stack top engaging conveyor;

wherein the stack bottom and top engaging conveyors are positioned to receive stacked sheet articles at a stack infeed end and are operable to deliver the stacked sheet articles to a stack discharge; and wherein the compression linkage is connected between the main frame and stack bottom engaging conveyor.

15. A counter-ejector for stacking relatively flat sheet articles, as defined by claim 9 wherein the compression linkage is a four bar type mechanical linkage with two fixed pivot points one of which defines the pivot axis and the other of which defines the compression frame axis.

16. A counter-ejector for stacking relatively flat sheet articles, as defined by claim 9 further comprising:

a stack bottom engaging conveyor on the compression frame;

wherein the stack bottom engaging conveyor includes a first working flight;

a stack top engaging conveyor on the main frame and spaced elevationally above the stack bottom engaging conveyor;

wherein the stack top engaging conveyor includes a second working flight;

wherein the stack bottom and top engaging conveyors are positioned to receive stacked sheet articles at a stack infeed end and are operable to deliver the stacked sheet articles to a stack discharge; and wherein the compression linkage is a four bar type mechanical linkage with two fixed pivot points one of which defines the pivot axis and the other of which defines the compression axis.

17. A counter-ejector for stacking relatively flat sheet articles, as defined by claim 9, further comprising:

a stack bottom engaging conveyor on the compression frame;

wherein the stack bottom engaging conveyor includes a first working flight;

a stack top engaging conveyor on the main frame and spaced elevationally above the stack bottom engaging conveyor;

wherein the stack top engaging conveyor includes a second working flight that is substantially parallel to and faces the first working flight;

wherein the stack bottom and top engaging conveyors are positioned to receive stacked sheet articles at a stack infeed end and are operable to deliver the stacked sheet articles between the first and second working flights to a stack discharge;

wherein the compression linkage includes three fixed pivot points one of which defines the pivot axis another which defines the compression axis; and a third fixed pivot point located on the base frame;

a rocker arm connected at one end to the main frame and pivoted at the third pivot point between the one end and a remaining end; and a pitman connecting the remaining end of rocker arm and the stack bottom engaging conveyor.

18. A counter-ejector for stacking relatively flat sheet articles, as defined by claim 9, further comprising:

a stack bottom engaging conveyor with a first working flight;

a stack top engaging conveyor with a second working flight; and wherein the first and second working flights are held in substantially parallel relation by the compression linkage.

19. A counter-ejector for stacking relatively flat sheet articles, as defined by claim 9, further comprising:

a stack bottom engaging conveyor on the compression frame;

wherein the stack bottom engaging conveyor includes a first working flight;

a stack top engaging conveyor on the main frame and spaced elevationally above the stack bottom engaging conveyor;

wherein the stack top engaging conveyor includes a second working flight; and wherein the first and second working flights are held in substantially parallel relation by the compression linkage.

20. A counter-ejector for stacking relatively flat sheet articles, comprising:

a fixed base;

a main frame on the base selectively movable about a pivot axis;

an infeed conveyor on the main frame leading to a discharge end positioned adjacent a stack forming station where individual sheet articles are discharged in forward and downward direction from the infeed conveyor to accumulate in a stack forming magazine;

a back stop mounted to the main frame along a side of the stack forming magazine opposite the discharge end of the infeed conveyor, positioned to engage and stop forward motion of the sheet articles fed from the infeed conveyor;

a lift platform on the main frame spanning a bottom side of the stack forming magazine and elevationally moveable toward and away from the discharge end of the infeed conveyor;

an ejector on the main frame adjacent the stack forming magazine and movable across the stack forming magazine from a stack engaging position to a shifted position at a stack compression station;

a compression frame on the base and pivotable thereon about a compression frame axis adjacent a stack discharge spaced downstream with respect to the forward path of travel from the pivot axis;

a stack compressor on the compression frame and main frame at the stack compression station, positioned to receive a stack of sheet articles from the ejector;

a compression linkage connecting the stack compression frame and main frame, with links arranged to adjustably open and close the stack compressor responsive to pivotal movement of the main frame about the pivot axis.

21. A counter-ejector for stacking relatively flat sheet articles, as defined by claim 20 wherein the back stop is adjustable elevationally with respect to the base.

22. A counter-ejector for stacking relatively flat sheet articles, as defined by claim 20 wherein the lift platform is adjustable elevationally with respect to the base.

23. A counter-ejector for stacking relatively flat sheet articles, as defined by claim 20 wherein the lift platform and back stop are mounted to an adjustable carriage on the main frame.

24. A process for stacking relatively flat sheet articles, comprising:

feeding sheet articles on an infeed conveyor mounted to a main frame along a forward path of travel;

discharging the sheet articles from the infeed conveyor into a stack forming magazine;

accumulating the discharged sheet articles within the stack forming magazine to form a stack of a selected stack height;

ejecting the stack from the stack forming magazine to a shifted position at a stack compression station;

compressing the stack with a stack compressor at the stack compression station; and selectively adjusting for the stack height by pivoting the main frame about a pivot axis and in response to such pivoting, adjusting the stack compressor to open and close according to the selected stack height in the stack forming magazine.

25. A process for stacking relatively flat sheet articles, as defined by claim 24 wherein the step of selectively adjusting for stack height includes the step of connecting the stack compressor and the main frame with a mechanical linkage.

26. A process for stacking relatively flat sheet articles, as defined by claim 24 wherein the step of selectively adjusting the stack height includes the step of connecting the stack compressor in a four bar type mechanical linkage.

27. A process for stacking relatively flat sheet articles, as defined by claim 24 comprising the further stop of directing an air stream downwardly against sheets discharged by the infeed conveyor.

28. A process for stacking relatively flat sheet articles, as defined by claim 24 comprising the further step of holding articles down on the infeed conveyor by a hold down conveyor and extending the hold down conveyor over the stack forming magazine.

29. A process for stacking relatively flat sheet articles, as defined by claim 24 comprising further step of:

receiving sheets at an infeed end of the infeed conveyor and discharging stacks of sheets from the stack compressor at a stack discharge end;

locating the pivot axis at a fixed point adjacent the infeed end of the infeed conveyor; and pivoting a compression frame of the compressor about a compression frame axis at a fixed point adjacent the stack discharge end.

30. A process for stacking relatively flat sheet articles, as defined by claim 24 comprising the further steps of:

receiving sheets at an infeed end of the infeed conveyor and discharging stacks of sheets from the stack compressor at a stack discharge end;

locating the pivot axis at a fixed point adjacent the infeed end of the infeed conveyor;

pivoting a compression frame of the compressor about a compression frame axis at a fixed point adjacent the stack discharge end;

interconnecting the compression frame and main frame with a linkage; and operating the linkage in response to pivotal motion of the main frame to pivot the compressor about the compression frame axis.

* * * * *

UNITED STATES PATENT AND TRADEMARK OFFICE

CERTIFICATE OF CORRECTION

PATENT NO. : 6,497,549 B2
DATED : December 24, 2002
INVENTOR(S) : Kevin P. Brown It is certified that error appears in the above-identified patent and that said Letters Patent is hereby corrected as shown below:

Column 1,
Line 59, after the word “movement”, insert -- in --.

Column 2,
Line 44, after the words “compressor at”, delete “an” and insert -- a --.

Column 7,
Line 16, after the words “operates for” delete “move” and insert -- moving --.

Column 15,
Line 29, after the word “further” delete “stop” and insert -- step --.

Signed and Sealed this

Fifth Day of August, 2003

JAMES E. ROGAN
*Director of the United States Patent and Trademark Office*